US010352636B2

(12) United States Patent
DeSomma

(10) Patent No.: US 10,352,636 B2
(45) **Date of Patent: *Jul. 16, 2019**

(54) BOLT CARRIER SUPPORT SYSTEM

(71) Applicant: Patriot Ordnance Factory, Inc., Phoenix, AZ (US)

(72) Inventor: Frank L. DeSomma, Glendale, AZ (US)

(73) Assignee: PATRIOT ORDNANCE FACTORY, INC., Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/025,593

(22) Filed: Jul. 2, 2018

(65) Prior Publication Data

US 2018/0321003 A1 Nov. 8, 2018

Related U.S. Application Data

(63) Continuation of application No. 15/002,096, filed on Jan. 20, 2016, now Pat. No. 10,012,462.

(60) Provisional application No. 62/105,716, filed on Jan. 20, 2015.

(51) Int. Cl.

| | |
|---|---|
| ***F41A 3/82*** | (2006.01) |
| ***F41A 3/66*** | (2006.01) |
| *F41A 3/26* | (2006.01) |

(52) U.S. Cl.

CPC ..... *F41A 3/82* (2013.01); *F41A 3/66* (2013.01); *F41A 3/26* (2013.01)

(58) Field of Classification Search

CPC ..... F41A 3/82; F41A 3/66; F41A 3/78; F41A 3/84

USPC ..... 89/198

See application file for complete search history.

(56) References Cited

U.S. PATENT DOCUMENTS

| | | | |
|---|---|---|---|
| 1,290,853 | A | 1/1919 | Sturgeon |
| 1,352,414 | A | 9/1920 | Payne |
| 1,357,208 | A | 10/1920 | Payne |
| 1,402,459 | A | 1/1922 | Gustaf |
| 1,738,501 | A | 12/1929 | Moore |
| 1,789,835 | A | 1/1931 | Pedersen |
| 1,879,603 | A | 9/1932 | Coupland |
| 1,912,757 | A | 6/1933 | Brump |
| 2,102,622 | A | 12/1937 | Green |
| 2,110,165 | A | 3/1938 | Moore |
| 2,116,141 | A | 5/1938 | Browning |

(Continued)

OTHER PUBLICATIONS

USPTO; Restriction Requirement dated Jul. 25, 2007 in U.S. Appl. No. 11/056,306.

(Continued)

*Primary Examiner* — Jonathan C Weber

(74) *Attorney, Agent, or Firm* — Snell & Wilmer, L.L.P.

(57) ABSTRACT

In various embodiments, a buffer retention system may comprise a body, a retention tab and a spring. The body may comprise a generally cylindrical portion and a partially annular guide portion. The generally cylindrical portion may define a channel. The partially annular guide portion may be operatively coupled to the cylindrical portion. The retention tab may be installable in the channel. The retention tab may be configured to protrude through the partially annular guide portion. The spring may be installable within the channel. The spring may be configured to position the retention tab through the partially annular guide portion.

11 Claims, 4 Drawing Sheets

(56) References Cited

U.S. PATENT DOCUMENTS

| | | | |
|---|---|---|---|
| 2,124,075 | A | 7/1938 | Moore |
| 2,287,066 | A | 6/1942 | Rogers |
| 2,391,864 | A | 1/1946 | Chandler |
| 2,437,548 | A | 3/1948 | William |
| 2,467,372 | A | 4/1949 | De Permentier |
| 2,482,880 | A | 9/1949 | Sefried |
| 2,570,292 | A | 10/1951 | Umsted |
| 2,816,484 | A | 12/1957 | Grages |
| 2,935,912 | A | 5/1960 | Hartley |
| 3,051,057 | A | 8/1962 | Ivy |
| 3,071,225 | A | 1/1963 | Blau et al. |
| 3,118,243 | A | 1/1964 | Manshel |
| 3,301,133 | A | 1/1967 | Sturtevant |
| 3,455,204 | A | 7/1969 | Stoner |
| 3,675,534 | A | 7/1972 | Beretta |
| 3,724,325 | A | 4/1973 | Silsby |
| 3,736,693 | A | 6/1973 | Koch |
| 3,908,214 | A | 9/1975 | Doloreto |
| 3,943,821 | A | 3/1976 | Seifried |
| 4,057,924 | A | 11/1977 | Joseph |
| 4,244,273 | A | 1/1981 | Langendorfer |
| 4,246,830 | A | 1/1981 | Krieger |
| 4,521,985 | A | 6/1985 | Smith et al. |
| 4,536,982 | A | 8/1985 | Bredbury |
| 4,576,083 | A | 3/1986 | Seberger |
| H000107 | H | 8/1986 | Bauer |
| D285,236 | S | 8/1986 | Brunton |
| 4,651,455 | A | 3/1987 | Geiser |
| 4,658,702 | A | 4/1987 | Tatro |
| 4,663,875 | A | 5/1987 | Tatro |
| 4,759,144 | A | 7/1988 | Egan et al. |
| 4,765,224 | A | 8/1988 | Morris |
| 4,937,964 | A | 7/1990 | Crandall |
| D329,078 | S | 9/1992 | Hasselbusch |
| 5,183,959 | A | 2/1993 | Mc Coan et al. |
| 5,272,956 | A | 12/1993 | Hudson |
| 5,343,650 | A | 9/1994 | Swan |
| 5,351,598 | A | 10/1994 | Schuetz |
| 5,386,659 | A | 2/1995 | Vaid et al. |
| 5,479,737 | A | 1/1996 | Osborne et al. |
| 5,543,787 | A | 8/1996 | Karidis et al. |
| 5,551,179 | A | 9/1996 | Young |
| 5,590,484 | A | 1/1997 | Mooney |
| 5,634,288 | A | 6/1997 | Martel |
| 5,726,377 | A | 3/1998 | Harris et al. |
| 5,770,814 | A | 6/1998 | Ealovega |
| D399,914 | S | 10/1998 | Walker |
| 5,827,992 | A | 10/1998 | Harris et al. |
| 5,930,935 | A | 8/1999 | Griffin |
| 5,983,774 | A | 11/1999 | Mihaita |
| 6,070,352 | A | 6/2000 | Daigle |
| 6,113,285 | A | 9/2000 | Ward |
| 6,209,250 | B1 | 4/2001 | Mills |
| 6,217,205 | B1 | 4/2001 | Ward |
| D447,791 | S | 9/2001 | Robidoux |
| 6,308,448 | B1 | 10/2001 | Kapusta et al. |
| 6,345,460 | B2 | 2/2002 | Hashman |
| 6,347,474 | B1 | 2/2002 | Wolff |
| D462,105 | S | 8/2002 | Myers |
| 6,470,615 | B1 | 10/2002 | Peterken |
| 6,490,822 | B1 | 12/2002 | Swan |
| 6,508,027 | B1 | 1/2003 | Kim |
| 6,508,159 | B1 | 1/2003 | Muirhead |
| D477,855 | S | 7/2003 | Selvaggio |
| 6,606,812 | B1 | 8/2003 | Gwinn |
| 6,634,274 | B1 | 10/2003 | Herring |
| 6,681,677 | B2 | 1/2004 | Herring |
| 6,694,660 | B1 | 2/2004 | Davies |
| 6,722,072 | B1 | 4/2004 | McCormick et al. |
| 6,722,255 | B2 | 4/2004 | Herring |
| 6,779,288 | B1 | 8/2004 | Kim |
| 6,827,130 | B2 | 12/2004 | Larson |
| 6,839,998 | B1 | 1/2005 | Armstrong |
| 6,848,351 | B1 | 2/2005 | Davies |
| 6,854,206 | B2 | 2/2005 | Oz |
| D504,168 | S | 4/2005 | McCormick |
| 6,921,181 | B2 | 7/2005 | Yen |
| 6,971,202 | B2 | 12/2005 | Bender |
| 7,051,467 | B1 | 5/2006 | Huber |
| 7,131,228 | B2 | 11/2006 | Hochstrate et al. |
| D544,063 | S | 6/2007 | Swan |
| 7,316,091 | B1 | 1/2008 | Desomma |
| 7,363,741 | B2 | 4/2008 | Desomma |
| 7,418,898 | B1 | 9/2008 | Desomma |
| 7,421,937 | B1 | 9/2008 | Gangl |
| 7,464,496 | B1 | 12/2008 | Davies |
| D590,473 | S | 4/2009 | Fitzpatrick et al. |
| D593,617 | S | 6/2009 | Dochterman |
| 7,584,567 | B1 | 9/2009 | Desomma |
| 7,600,338 | B2 | 10/2009 | Geissele |
| D604,793 | S | 11/2009 | Fitzpatrick et al. |
| 7,753,679 | B1 | 7/2010 | Schuetz |
| 7,784,211 | B1 | 8/2010 | Desomma |
| D624,609 | S | 9/2010 | Stein et al. |
| 7,798,045 | B1 | 9/2010 | Fitzpatrick et al. |
| 7,827,722 | B1 | 11/2010 | Davies |
| D629,062 | S | 12/2010 | Peterson et al. |
| 7,856,917 | B2 | 12/2010 | Noveske |
| D630,698 | S | 1/2011 | Peterson et al. |
| D631,933 | S | 2/2011 | Thompson |
| 7,891,284 | B1 | 2/2011 | Barrett |
| 7,905,041 | B1 | 3/2011 | Davies |
| 7,930,968 | B2 | 4/2011 | Giefing |
| D643,086 | S | 8/2011 | Peterson et al. |
| D645,532 | S | 9/2011 | Peterson et al. |
| 8,056,460 | B2 | 11/2011 | Herring |
| 8,091,265 | B1 | 1/2012 | Teetzel |
| 8,161,864 | B1 | 4/2012 | Vuksanovich |
| 8,230,634 | B1 | 7/2012 | Davies |
| 8,261,653 | B2 | 9/2012 | Crommett |
| 8,359,966 | B1 | 1/2013 | Brotherton |
| 8,375,616 | B2 | 2/2013 | Gomez |
| 8,381,628 | B1 | 2/2013 | Wheatly |
| 8,479,428 | B1 | 7/2013 | Desomma |
| D708,693 | S | 7/2014 | Faxon |
| D713,483 | S | 9/2014 | Firpo |
| 8,826,797 | B2 | 9/2014 | Overstreet |
| 8,844,424 | B2 | 9/2014 | Gomez |
| D716,404 | S | 10/2014 | Capps |
| 8,863,637 | B2 | 10/2014 | Hall |
| 8,869,674 | B2 | 10/2014 | Ruck |
| D717,904 | S | 11/2014 | Oglesby |
| 8,875,614 | B2 | 11/2014 | Gomez |
| D720,032 | S | 12/2014 | Boutin |
| 8,910,406 | B1 | 12/2014 | Huang |
| 8,978,282 | B2 | 3/2015 | Garrett |
| 9,032,860 | B2 | 5/2015 | Faxon |
| D741,978 | S | 10/2015 | Shea |
| 9,194,638 | B2 | 11/2015 | Larson et al. |
| D745,621 | S | 12/2015 | Huang |
| D748,754 | S | 2/2016 | Chastain |
| D750,725 | S | 3/2016 | Capps |
| 9,291,412 | B1 | 3/2016 | Montes |
| 9,303,949 | B1 | 4/2016 | Oglesby |
| D755,339 | S | 5/2016 | Geissele |
| D757,199 | S | 5/2016 | Bender |
| D760,860 | S | 7/2016 | Vincent |
| D763,397 | S | 8/2016 | Huang |
| D764,004 | S | 8/2016 | Bender |
| 9,423,194 | B2 | 8/2016 | Fritz |
| 9,429,375 | B2 | 8/2016 | DeSomma |
| D768,801 | S | 10/2016 | Morris |
| D771,767 | S | 11/2016 | Niswander |
| 9,523,557 | B2 | 12/2016 | Sharron |
| 9,523,558 | B2 | 12/2016 | Visinski |
| 9,528,793 | B1 | 12/2016 | Oglesby |
| D777,285 | S | 1/2017 | Bender |
| 10,012,462 | B2 * | 7/2018 | DeSomma ..... F41A 3/82 |
| 2003/0010186 | A1 | 1/2003 | Muirhead |
| 2003/0010187 | A1 | 1/2003 | Muirhead |
| 2004/0064994 | A1 | 4/2004 | Luke |
| 2004/0226212 | A1 | 11/2004 | Shiloni |
| 2005/0000142 | A1 | 1/2005 | Kim et al. |
| 2005/0223613 | A1 | 10/2005 | Bender |

(56) References Cited

U.S. PATENT DOCUMENTS

| | | | |
|---|---|---|---|
| 2005/0241211 | A1 | 11/2005 | Swan |
| 2005/0262752 | A1 | 12/2005 | Robinson et al. |
| 2005/0262997 | A1 | 12/2005 | Brixius |
| 2006/0010748 | A1 | 1/2006 | Stoner et al. |
| 2006/0026883 | A1 | 2/2006 | Hochstrate et al. |
| 2006/0236582 | A1 | 10/2006 | Lewis et al. |
| 2006/0265925 | A1 | 11/2006 | Murello |
| 2006/0265926 | A1 | 11/2006 | Sietsema |
| 2006/0277810 | A1 | 12/2006 | Leitner-Wise |
| 2007/0006509 | A1 | 1/2007 | Desomma |
| 2007/0033851 | A1 | 2/2007 | Hochstrate et al. |
| 2007/0051236 | A1 | 3/2007 | Groves et al. |
| 2007/0079539 | A1 | 4/2007 | Karagias |
| 2007/0169393 | A1 | 7/2007 | Frost |
| 2007/0180984 | A1 | 8/2007 | Huther |
| 2007/0199435 | A1 | 8/2007 | Hochstrate et al. |
| 2008/0078284 | A1 | 4/2008 | Murello |
| 2009/0223357 | A1 | 9/2009 | Herring |
| 2009/0249672 | A1 | 10/2009 | Zedrosser |
| 2009/0313873 | A1 | 12/2009 | Roth |
| 2010/0000400 | A1 | 1/2010 | Brown |
| 2010/0251591 | A1 | 10/2010 | Burt |
| 2010/0307042 | A1 | 12/2010 | Jarboe |
| 2010/0319231 | A1 | 12/2010 | Stone et al. |
| 2010/0319527 | A1 | 12/2010 | Giefing |
| 2011/0000119 | A1 | 1/2011 | Desomma |
| 2011/0016762 | A1 | 1/2011 | Davies |
| 2011/0056107 | A1 | 3/2011 | Underwood |
| 2011/0214327 | A1 | 9/2011 | Desomma |
| 2011/0265638 | A1 | 11/2011 | Overstreet |
| 2011/0271827 | A1 | 11/2011 | Larson |
| 2011/0283580 | A1 | 11/2011 | Esch |
| 2012/0117845 | A1 | 5/2012 | Desomma |
| 2012/0167757 | A1 | 7/2012 | Gomez |
| 2012/0174451 | A1 | 7/2012 | Overstreet |
| 2012/0260793 | A1 | 10/2012 | Gomez |
| 2012/0297656 | A1 | 11/2012 | Langevin |
| 2013/0098235 | A1 | 4/2013 | Reinken |
| 2013/0174721 | A1 | 7/2013 | Langevin |
| 2013/0219763 | A1 | 8/2013 | Nunes |
| 2013/0220295 | A1 | 8/2013 | Wood et al. |
| 2013/0227869 | A1 | 9/2013 | Thordsen |
| 2014/0000142 | A1 | 1/2014 | Patel |
| 2014/0060312 | A1 | 3/2014 | Ruck |
| 2014/0075804 | A1 | 3/2014 | Langevin |
| 2014/0076149 | A1 | 3/2014 | Adams |
| 2014/0090283 | A1 | 4/2014 | Gomez |
| 2014/0115938 | A1 | 5/2014 | Jarboe |
| 2014/0224114 | A1 | 8/2014 | Faxon |
| 2014/0260945 | A1 | 9/2014 | Desomma |
| 2014/0311007 | A1 | 10/2014 | Capps |
| 2014/0352191 | A1 | 12/2014 | Fritz |
| 2015/0007476 | A1 | 1/2015 | Dextraze |
| 2015/0040455 | A1 | 2/2015 | Lewis |
| 2015/0168092 | A1 | 6/2015 | Stone |
| 2015/0198409 | A1 | 7/2015 | Desomma |
| 2015/0226501 | A1 | 8/2015 | Gibbens |
| 2015/0253091 | A1 | 9/2015 | Gardner |
| 2015/0323269 | A1 | 11/2015 | McGinty |
| 2015/0330733 | A1 | 11/2015 | Desomma |
| 2015/0345879 | A1 | 12/2015 | Jen |
| 2015/0362270 | A1 | 12/2015 | Stewart |
| 2015/0369558 | A1 | 12/2015 | Gottzmann |
| 2016/0178297 | A1 | 6/2016 | Sharps |
| 2016/0209137 | A1 | 7/2016 | DeSomma |
| 2016/0209138 | A1 | 7/2016 | Desomma |
| 2017/0051989 | A1 | 2/2017 | DeSomma |
| 2017/0153075 | A1 | 6/2017 | DeSomma |
| 2017/0307321 | A1 | 10/2017 | DeSomma |

OTHER PUBLICATIONS

USPTO; Non-Final Office Action dated Oct. 10, 2007 in U.S. Appl. No. 11/056,306.
USPTO; Notice of Allowance dated May 9, 2008 in U.S. Appl. No. 11/056,306.
USPTO; Restriction Requirement dated Nov. 15, 2006 in U.S. Appl. No. 11/174,270.
USPTO; Non-Final Office Action dated Mar. 15, 2007 in U.S. Appl. No. 11/174,270.
USPTO; Final Office Action dated Sep. 26, 2007 in U.S. Appl. No. 11/174,270.
USPTO; Notice of Allowance dated Jan. 14, 2008 in U.S. Appl. No. 11/174,270.
USPTO; Non-Final Office Action dated Jan. 18, 2007 in U.S. Appl. No. 11/232,521.
USPTO; Final Office Action dated Jun. 15, 2007 in U.S. Appl. No. 11/232,521.
USPTO; Notice of Allowance dated Aug. 15, 2007 in U.S. Appl. No. 11/232,521.
USPTO; Non-Final Office Action dated Apr. 29, 2008 in U.S. Appl. No. 11/442,035.
USPTO; Notice of Allowance dated Sep. 30, 2008 in U.S. Appl. No. 11/442,035.
USPTO; Non-Final Office Action dated Dec. 27, 2007 in U.S. Appl. No. 11/527,851.
USPTO; Final Office Action dated Aug. 13, 2008 in U.S. Appl. No. 11/527,851.
USPTO; Non-Final Office Action dated Mar. 3, 2009 in U.S. Appl. No. 11/527,851.
USPTO; Final Office Action dated Sep. 1, 2009 in U.S. Appl. No. 11/527,851.
USPTO; Notice of Allowance dated Mar. 29, 2013 in U.S. Appl. No. 11/527,851.
USPTO; Non-Final Office Action dated Dec. 14, 2009 in U.S. Appl. No. 11/947,294.
USPTO; Notice of Allowance dated May 5, 2010 in U.S. Appl. No. 11/947,294.
USPTO; Non-Final Office Action dated Dec. 11, 2008 in U.S. Appl. No. 12/110,304.
USPTO; Notice of Allowance dated May 29, 2009 in U.S. Appl. No. 12/110,304.
USPTO; Non-Final Office Action dated Nov. 24, 2010 in U.S. Appl. No. 12/489,592.
USPTO; Notice of Allowance dated Mar. 3, 2011 in U.S. Appl. No. 12/489,592.
USPTO; Non-Final Office Action dated Feb. 17, 2013 in U.S. Appl. No. 12/497,048.
USPTO; Non-Final Office Action dated Feb. 15, 2012 in U.S. Appl. No. 13/098,196.
USPTO; Final Office Action dated Jun. 11, 2012 in U.S. Appl. No. 13/098,196.
USPTO; Non-Final Office Action dated Feb. 21, 2012 in U.S. Appl. No. 13/105,893.
USPTO; Final Office Action dated Apr. 13, 2012 in U.S. Appl. No. 13/105,893.
USPTO; Advisory Action dated Apr. 26, 2012 in U.S. Appl. No. 13/105,893.
USPTO; Notice of Allowance dated Jun. 22, 2012 in U.S. Appl. No. 13/105,893.
USPTO; Non-Final Office Action dated Feb. 15, 2012 in U.S. Appl. No. 13/358,347.
USPTO; Non-Final Office Action dated Jun. 6, 2012 in U.S. Appl. No. 13/358,347.
USPTO; Non-Final Office Action dated Feb. 27, 2013 in U.S. Appl. No. 13/708,025.
USPTO; Final Office Action dated Sep. 26, 2013 in U.S. Appl. No. 13/708,025.
USPTO; Non-Final Office Action dated Dec. 17, 2013 in U.S. Appl. No. 13/835,842.
USPTO; Final Office Action dated Jun. 4, 2014 in U.S. Appl. No. 13/835,842.
USPTO; Non-Final Office Action dated Oct. 24, 2014 in U.S. Appl. No. 13/835,842.
USPTO; Final Office Action dated Jun. 18, 2015 in U.S. Appl. No. 13/835,842.

(56) References Cited

OTHER PUBLICATIONS

USPTO; Non-Final Office Action dated Jan. 5, 2016 in U.S. Appl. No. 13/835,842.
USPTO; Final Office Action dated Jun. 1, 2016 in U.S. Appl. No. 13/835,842.
USPTO; Non-Final Office Action dated Jan. 29, 2015 in U.S. Appl. No. 14/216,733.
USPTO; Final Office Action dated Jul. 16, 2015 in U.S. Appl. No. 14/216,733.
USPTO; Non-Final Office Action dated Jan. 14, 2016 in U.S. Appl. No. 14/527,698.
USPTO; Notice of Allowance dated Apr. 25, 2016 in U.S. Appl. No. 14/527,698.
USPTO; Non-Final Office Action dated Aug. 17, 2015 in U.S. Appl. No. 14/596,018.
USPTO; Non-Final Office Action dated Jun. 22, 2016 in U.S. Appl. No. 15/002,382.
USPTO; Restriction Requirement dated Apr. 24, 2014 in U.S. Appl. No. 29/449,556.
USPTO; Notice of Allowance dated Jul. 7, 2014 in U.S. Appl. No. 29/449,556.
USPTO; Notice of Allowance dated Oct. 13, 2015 in U.S. Appl. No. 29/502,433.
USPTO; Non-Final Office Action dated Dec. 1, 2016 in U.S. Appl. No. 13/835,842.
USPTO; Notice of Allowance dated Jan. 11, 2017 in U.S. Appl. No. 29/551,847.
USPTO; Restriction Requirement Office Action dated Jan. 27, 2017 in U.S. Appl. No. 15/002,382.
USPTO; Notice of Allowance dated Mar. 30, 2017 in U.S. Appl. No. 29/551,237.
USPTO; Final Office Action dated May 19, 2017 in U.S. Appl. No. 15/002,382.
USPTO; Non-Final Office Action dated Jun. 13, 2017 in U.S. Appl. No. 15/250,218.
USPTO; Final Office Action dated Jun. 28, 2017 in U.S. Appl. No. 13/835,842.
USPTO; Restriction Requirement Office Action dated Oct. 31, 2017 in U.S. Appl. No. 15/410,534.
USPTO; Restriction Requirement Office Action dated Oct. 16, 2017 in U.S. Appl. No. 15/342,981.
USPTO; Office Action dated Jan. 9, 2018 in U.S. Appl. No. 13/835,842.
USPTO; Office Action dated Dec. 12, 2017 in U.S. Appl. No. 15/002,382.
USPTO; Office Action dated Jan. 18, 2018 in U.S. Appl. No. 15/410,534.
USPTO; Non-Final Office Action dated Feb. 1, 2018 in U.S. Appl. No. 15/342,981.
USPTO; Notice of Allowance dated Mar. 29, 2018 in U.S. Appl. No. 15/250,218.
POF-USA Patriot Ordnance Factory, Inc., Upper Receiver web page, Retrieved from http://web.archive.org/web/20100922070336/http://www.pof-usa.com/upper/upperreceiver.html[Sep. 17, 2012 9:19:17 AM].
Rainer Arms Forged Mil-Spec Upper Minus FA 9mm / .22 LR, RainierArms.com, [online], [site visited Dec. 30, 2016]. <URL: http://www.rainierarms.com/rainier-arms-forged-mil-spec-upper-minus-fa-22-lr>.
Rainer Arms Forged A4 Upper Receiver-GEN2, RainierArms.com, [online], [site visited Dec. 30, 2016]. <URL: http://www.rainierarms.com/rainier-arms-forged-A4-upper-receiver-gen2>.
Rainer Arms Forged Mil-Spec Upper Minus FA 1/LOGO, RainierArms.com, [online], [site visited Dec. 30, 2016]. <URL: http://www.rainierarms.com/rainier-arms-forged-mil-spec-upper-minus-fa-w-logo>.
BCM M4 Arms Upper Receiver Assembly, RainierArms.com, [online], [site visited Dec. 30, 2016]. <URL: http://www.rainierarms.com/bcm-m4-upper-receiver-assembly>.
NorthTech Defense Non Forward Assist AR15 Billet Upper Receiver, RainierArms.com, [online], [site visited Dec. 30, 2016]. <URL: http://www.rainierarms.com/northtech-defense-non-forward-assist-ar15-billet-upper-receiver>.
SAAAR 15 Stripped Flat Top Upper Receiever—No Mark, SurplusAmmo.com, [online], [site visited Dec. 30, 2016]. <URL: http://www.surplusammo.com/saa-ar15-stripped-flat-top-upper-receiver-no-mark/>.
Aero Precision Assembled AR-15 Upper receiever with Port Door and Forward Assist, PrimaryArms.com, [online], [site visited Dec. 30, 2016]. URL: http://www.primaryarms.com/aero-precision-assembled-ar-15-upper-receiver-with-port-door-and-forward-assist-ap501603-asmbly>.
Anderson Manufacturing AR-15 Stripped Upper Receiver, PrimaryArms.com, [online], [site visited Dec. 30, 2016]. <URL: http://www.primaryarms.com/anderson-manufacturing-ar-15-stripped-upper-receiver-ar-15-a3-upfor-um>.
Vltor MUR Modular Upper Receiver with Shell Deflector Only Assembled AR-15 Matte, MidwayUSA.com, [online], [site visited Dec. 30, 2016]. <URL:http://www.midwayusa.com/product/478529/vltor-mur-modular-upper-receiver-with-shell-deflector-only-assembled-ar-15-matte>.
LanTac USA LA00221 AR-15 UAR Stripped Upper Receiver 5.56mm Black, TombStoneTactical.com, [online], [site visited Dec. 13, 2016]. <URL:http://www.tombstonetactical.com/catalog/lantac-usa/la00221-ar15-uar-stripped-upper-receiver-5.56mm-black/>.
AR15-A3 Stripped Upper Receiver, FrederickArms.com, [online], [site visited Dec. 30, 2016]. <URL:http://www.frederickarms.com/ar15-a3-stripped-upper-receiver.html>.
Upper Receiver AR-15, CrossHairCustoms.com, [online], [site visited Dec. 30, 2016]. <URL:http://www.crosshaircustoms.com'/product/ar-15-upper-receiver/>.
USPTO; Non-Final Office Action dated Jun. 23, 2016 in U.S. Appl. No. 15/002,096.
USPTO; Final Office Action dated Dec. 27, 2016 in U.S. Appl. No. 15/002,096.
USPTO; Non-Final Office Action dated Apr. 10, 2017 in U.S. Appl. No. 15/002,096.
USPTO; Final Office Action dated Sep. 28, 2017 in U.S. Appl. No. 15/002,096.
USPTO; Notice of Allowance dated Mar. 26, 2018 in U.S. Appl. No. 15/002,096.
User: Always Armed, "First AR Build (for myself that is)", Mar. 23, 2014, MossbergOwners.com, Retrieved from <http://mossergowners.com/forum/index.php?threads/first-ar-build-for-mysief-that-is.11491/page-4>, pp. 1-101, Accessed Sep. 22, 2017.
User: Paulo_Santos, PWS & POF Enhanced Buffer Tube Review, Feb. 9, 2011, Weapon Evolution, <http://www.weaponevolution.com/forum/showthread.php?3005-PWS-amp-POF-Enhanced-Buffer-Tube-Reviews>, Entire thread, pp. 1-11, Accessed Sep. 22, 2017.
User: Always Armed, "First AR Build (for myself that is)", Mar. 23, 2014, MossbergOwners.com, Retrieved from <http://mossergowners.com/forum/index.php?threads/first-ar-build-for-myslef-that-is.11491/page-4>, pp. 1-101, Accessed Sep. 22, 2017.
USPTO; Notice of Allowance dated Jul. 18, 2018 in U.S. Appl. No. 15/410,534.
USPTO; Final Office Action dated Aug. 27, 2018 in U.S. Appl. No. 13/835,842.
USPTO; Final Office Action dated Sep. 11, 2018 in U.S. Appl. No. 15/342,981.
USPTO; Notice of Allowance dated Sep. 20, 2018 in U.S. Appl. No. 15/002,382.

* cited by examiner

BOLT CARRIER SUPPORT SYSTEM

CROSS REFERENCE TO RELATED APPLICATIONS

This application claims priority to and the benefit of U.S. Ser. No. 15/002,096 filed Jan. 20, 2016 and entitled "BOLT CARRIER SUPPORT SYSTEM". The '096 application claims priority to and the benefit of Provisional Application Ser. No. 62/105,716, filed Jan. 20, 2015 and entitled "BOLT CARRIER SUPPORT SYSTEM," which both are hereby incorporated by reference in their entirety for all purposes.

FIELD

The disclosure relates to devices, systems and methods for eliminating bolt tilt in AR-15 style rifles. More specifically, the disclosure relates to a bolt carrier guide and support.

BACKGROUND

AR-15 style rifles may be susceptible to buffer tube wear as a result of bolt cycling during operation. The bolt carrier may wear the buffer tube, which may in turn reduce the reliability of AR-15 style rifles. Generally, the buffer tube is a thin walled tube made from aluminum or another suitable material. The bolt carrier may be a harder material (e.g., steel) than the buffer tube. Moreover, the bolt carrier may be a denser material, have greater mass, and may be less susceptible to wear than the thin walls of the buffer tube.

SUMMARY

In various embodiments, a buffer retention system may comprise a body, a retention tab and a spring. The body may comprise a generally cylindrical portion and a partially annular guide portion. The generally cylindrical portion may define a channel. The partially annular guide portion may be operatively coupled to the cylindrical portion. The retention tab may be installable in the channel. The retention tab may protrude through the partially annular guide portion. The spring may be located within the channel. The spring may be configured to position the retention tab through the partially annular guide portion.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of various embodiments herein makes reference to the accompanying drawings, which show various embodiments by way of illustration and their best mode. While these various embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Also, any reference to attached, fixed, connected or the like may include permanent, removable, temporary, partial, full and/or any other possible attachment option. Additionally, any reference to without contact (or similar phrases) may also include reduced contact or minimal contact.

Furthermore, any reference to singular includes plural embodiments, and any reference to more than one component or step may include a singular embodiment or step. Surface shading lines may be used throughout the figures to denote different parts but not necessarily to denote the same or different materials.

In various embodiments, an AR-15 style rifle may be any suitable pistol or rifle that is modeled after or substantially similar to the design first introduced by Eugene Stoner. The AR-15 style rifle may be a semi-automatic, fully automatic or manual actuated rifle. The AR-15 style rifle may generally comprise an upper receiver operatively coupled to a lower receiver. A barrel may be operatively coupled to the upper receiver. The upper receiver may be configured with a bolt carrier that is configured to translate between a battery position and an out of battery position. The AR-15 style rifle may be generally configured to fire any suitable caliber of ammunition. The AR-15 style rifle may be configured with any suitable actuation system including for example, a gas piston system, a gas impingement system, a manual actuation system, and/or the like.

Figure 1:
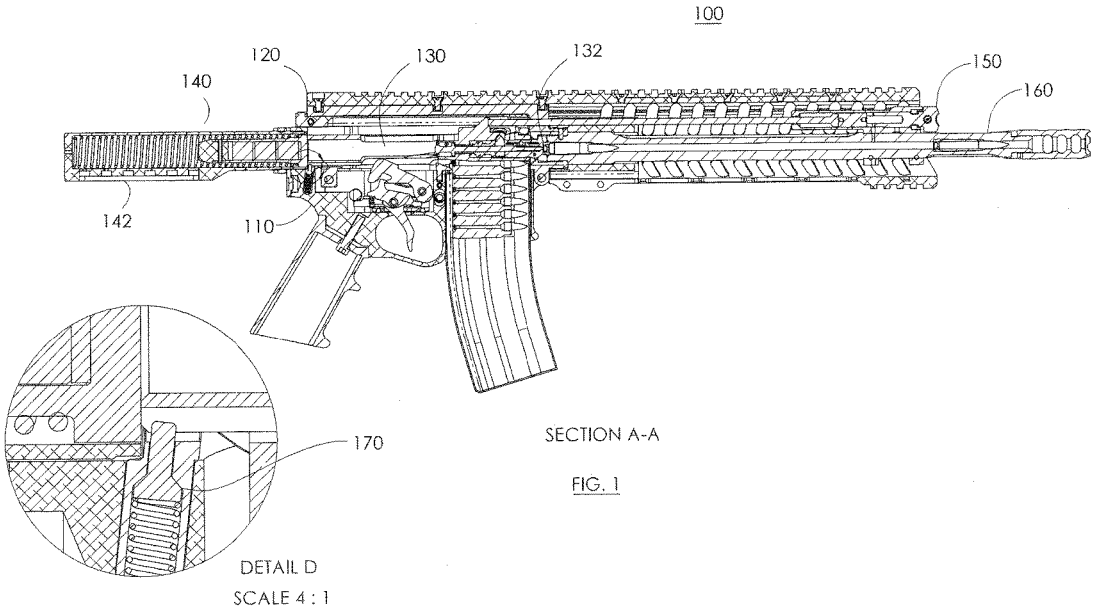
FIG. 1 is a cross-sectional view of an AR-15 style rifle, in accordance with various embodiments.

In various embodiments and with reference to FIG. 1, firearm 100 may comprise a lower receiver 110, an upper receiver 120, a bolt carrier 130, a buffer system 140, an operating system 150, and a barrel 160. Firearm 100 may further comprise various other components including, for example, a handguard, a magazine, a handle, a trigger, and or other suitable components. Upper receiver 120 and lower receiver 110 may operably couple to one another. Bolt carrier 130 may be installable in, and slideably operate in upper receiver 120 in response to receiving an input from operating system 150. Operating system 150 may be any suitable operating system, including for example, a gas piston system (e.g. as is shown in FIG. 1), a direct impingement operating system, a manual operating system and/or the like. In various embodiments, firearm 100 may be a rotating bolt firearm (e.g., an AR-15 style piston or direct impingement operated system). A bolt 132 may be located within bolt carrier 130. Bolt 132 may be rotatably moveable between a first position and a second position in response to an input from operating system 150 and/or a user engagement of the trigger.

In various embodiments, barrel 160 may be coupled to upper receiver 120. Barrel 160 may be configured to receive a round of ammunition. When bolt carrier 130 is in the battery position, firearm 100 may be configured to fire a round of ammunition through barrel 160. In response to a round of ammunition being fired, operating system 150 may actuate bolt carrier 130 from the battery position to the out of battery position. This actuation from the battery position may cause bolt carrier 130 to travel aft (e.g., away from the direction of fire or away from the muzzle of firearm 100) and cyclically engage buffer system 140.

In various embodiments, buffer system 140 may comprise and/or be housed in a buffer tube 142. Buffer tube 142 may be a thin walled substantially cylindrical structure. Buffer tube 142 may be configured to support at least a portion of bolt carrier 130 as bolt carrier 130 travels from the battery to out-of-battery positions as firearm 100 operates (e.g., in response to firearm 100 firing a cartridge).

In various embodiments, firearm 100 may further comprise a buffer retention system 170. Buffer retention system 170 may be installable in lower receiver 110. Buffer retention system 170 may be configured to engage and/or contact a portion of buffer system 140 to retain buffer system 140 on lower receiver 110.

Figure 2A:
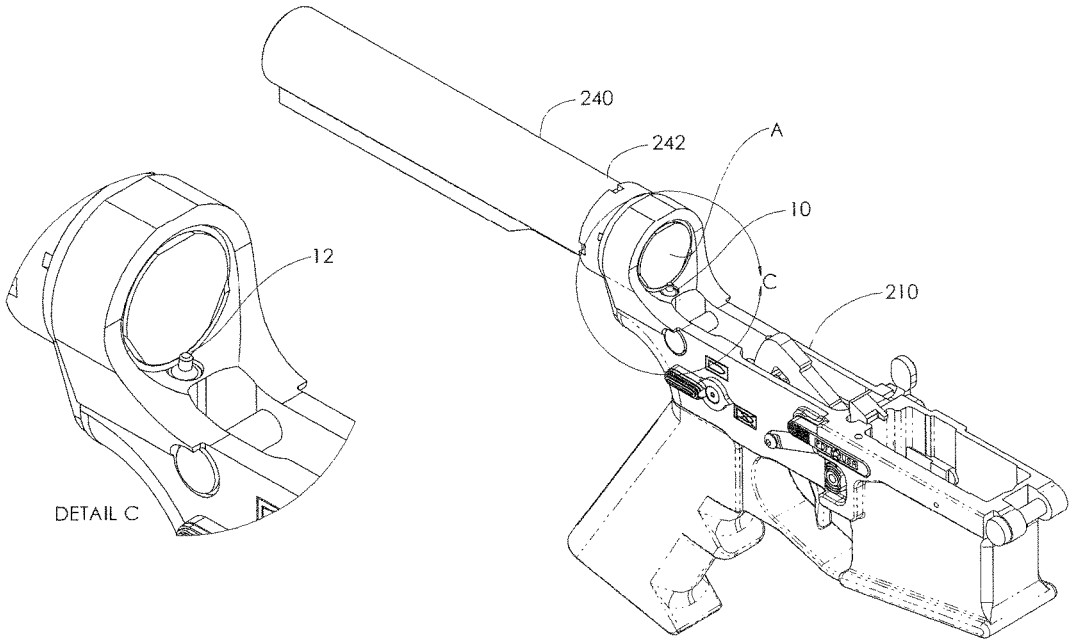
FIG. 2A (Prior Art)
FIG. 2A is a perspective view of a portion of a prior art AR-15 style rifle.

Referring now to FIG. 2A, lower receiver 210 is shown with a typical buffer retention system 10. This typical buffer retention system 10 may be generally available and is typically installed in AR-15 style rifles to retain buffer system 240 to lower receiver 210. Buffer retention system 10 may generally include a retaining tab 12 and a cylindrical body. The cylindrical body may comprise a spring that creates a force in buffer retention system 10 causing retaining tab 12 to engage buffer tube 242.

In operation, typical AR-15 systems may experience bolt tilt. Bolt tilt may occur when a typical bolt carrier is actuated and the aft end of the bolt carrier tilts down engaging an area A of buffer tube 242. Typical AR-15 style rifles may experience failures in buffer system 240 when equipped with a typical buffer retention system 10. In this regard, a bolt carrier may engage a forward portion A of a buffer tube 242 of buffer system 240. After repeated cycling, the bolt carrier may generally wear away the thin wall of buffer tube 242 at area A. This wear of area A may create thinning of the wall of buffer tube 242 in the region associated with area A. This wear at area A may further cause failure modes such as buffer tube cracking, which may lead to failure of a typical AR-15 style rifle.

Figure 2B:
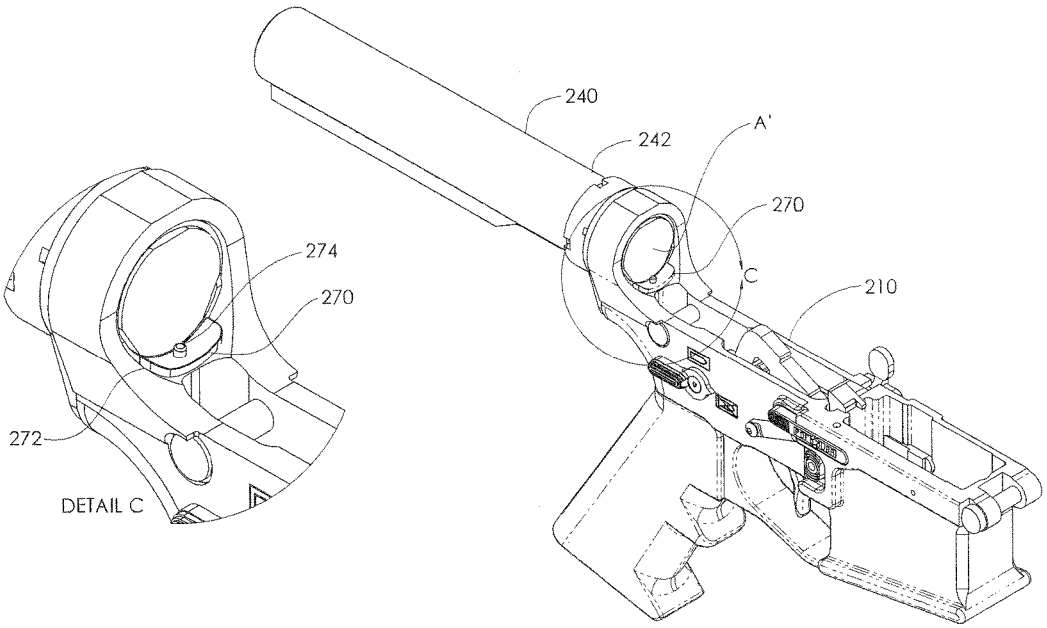
FIG. 2B is a perspective view of a portion of an AR-15 style rifle comprising a bolt support system, in accordance with various embodiments.

In various embodiments and with reference to FIG. 2B, buffer retention system 270 may be operably installed in lower receiver 210. Moreover, buffer retention system 270 may be configured to guide a bolt carrier during operation to avoid contact with area A' of buffer tube 242. Buffer retention system 270 may be configured to support and guide an aft portion of the bolt carrier.

In various embodiments, buffer retention system 270 may be a spring loaded assembly comprising a guide 272 and a retaining pin 274. Guide 272 may generally have an annular support surface that is configured to engage and support the aft portion of the bolt carrier. Guide 272 may be located adjacent to and forward of a lower portion of the buffer tube 242. Moreover, retaining pin 274 may be positively forced and retained within, and pass through guide 272.

Figure 3A:
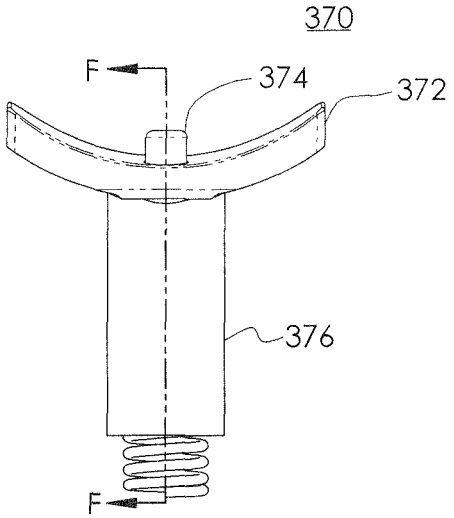
FIG. 3A is a front view of a bolt support system, in accordance with various embodiments.
Figure 3B:
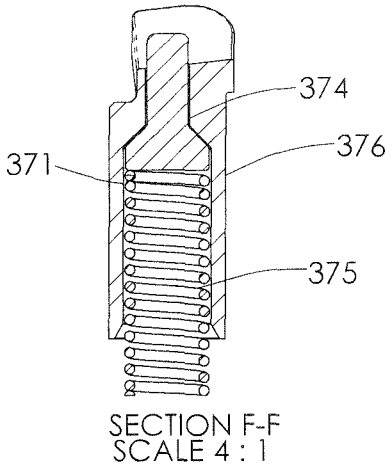
FIG. 3B is a side cross-sectional view of a bolt support system, in accordance with various embodiments.
Figure 3C:
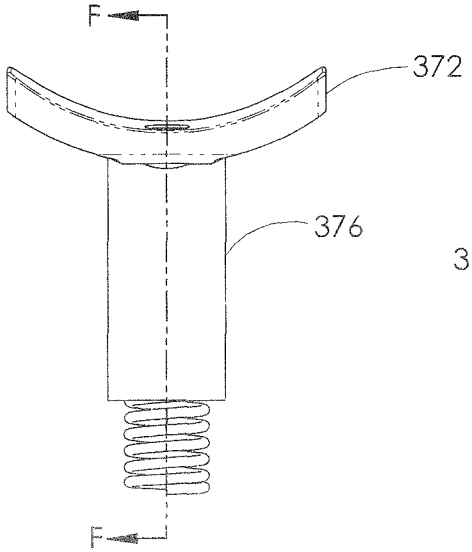
FIG. 3C is a front view of a portion of a bolt support system, in accordance with various embodiments.
Figure 3D:
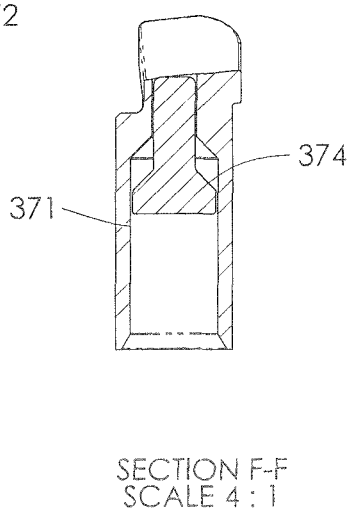
FIG. 3D is a side cross-sectional view of a portion of bolt support system, in accordance with various embodiments.

In various embodiments and with reference to FIG. 3A through FIG. 3D, buffer retention system 370 may generally comprise a body 376, a guide 372, a retaining pin 374, and a spring 375. Guide 372 may be coupled to body 376. Guide 372 may be removable from body 376 or guide 372 and body 376 may be formed as a single integral piece. Body 376 may comprise an internal channel 371 as shown in FIG. 3B and FIG. 3D. The internal channel may be configured to receive retaining pin 374 and spring 375 as shown in FIG. 3B (note that spring 375 is not shown in FIG. 3D). When installed in the lower receiver of an AR-15 style rifle, spring 375 may load retaining pin 374 causing retaining pin 374 to protrude through guide 372 when retaining pin 374 is installed in body 376.

In various embodiments, the buffer tube retaining systems described herein may be installed in any suitable AR-15 style rifle that comprises a typical buffer retaining pin as discussed herein. In this regard, the retaining systems may be provided as replacement parts to remedy the wear created during cyclic operation by the bolt carrier of the buffer system.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A firearm comprising a buffer retention system located within a lower receiver of the firearm, the buffer retention system comprising:

a generally cylindrical portion defining a channel in an interior of the generally cylindrical portion;

a partially annular guide portion located forward of a lower portion of a buffer tube, wherein the partially annular guide portion is coaxial with the buffer tube, wherein a support surface of the partially annular guide portion is configured to engage and support a portion of a bolt carrier, wherein the generally cylindrical portion and the partially annular guide portion are removable from the lower receiver;

a retaining pin configured to translate within the channel, wherein the retaining pin is configured to retain a buffer within the buffer tube; and a spring located within the channel and configured to position the retaining pin through an aperture of the partially annular guide portion.

2. The buffer retention system of claim 1, wherein the firearm is an AR-15 style rifle.

3. The buffer retention system of claim 1, wherein the buffer retention system is configured to engage and retain the buffer tube.

4. The buffer retention system of claim 1, wherein the buffer retention system is configured to support and guide an aft portion of the bolt carrier.

5. The buffer retention system of claim 1, wherein the partially annular guide portion is configured to remain stationary in response to the retaining pin compressing the spring.

6. The buffer retention system of claim 1, wherein the partially annular guide portion is configured to remain flush with the buffer tube in response to the retaining pin compressing the spring.

7. The buffer retention system of claim 1, wherein the generally cylindrical portion and the partially annular guide portion are a single integral piece.

8. A firearm, comprising:

an upper receiver comprising:

an operating system; and a bolt rotatably moveable between a first position and a second position in response to an input from the operating system;

a barrel configured to receive the bolt;

a buffer system comprising a buffer located within a buffer tube; and a lower receiver operatively coupled to the buffer tube, the lower receiver comprising:

a buffer retention system comprising:

a channel portion removably installed within the lower receiver;

a guide portion located forward of a lower portion of the buffer tube, wherein a support surface of the guide portion is configured to engage and support a portion of a bolt carrier, wherein the support surface is flush with the buffer tube, wherein the support surface is perpendicular to the channel portion, wherein the channel portion is not coaxial with the buffer tube; and a retaining pin configured to translate within the channel portion, wherein contact between the retaining pin and an interior of the channel portion is configured to keep the retaining pin within the channel portion.

9. The firearm of claim 8, wherein the guide portion is configured to remain stationary in response to the retaining pin compressing a spring in the channel portion.

10. The firearm of claim 8, wherein the guide portion is configured to remain flush with the buffer tube in response to the retaining pin compressing a spring in the channel portion.

11. The firearm of claim 8, wherein the channel portion and the guide portion are a single integral piece.

* * * * *